US005377597A

United States Patent [19]

Richter et al.

[11] Patent Number: 5,377,597

[45] Date of Patent: Jan. 3, 1995

[54] RAIL VEHICLE HAVING ARTICULATED CONNECTION BETWEEN VEHICLE BODIES FOR PROHIBITING TELESCOPING IN CASE OF ACCIDENTS

[75] Inventors: Wolfgang-Dieter Richter, Winkelhaid; Wolfgang David, Donauworth; Engelbert Weeger, Nurnberg; Bernhard Hartmann, Mering, all of Germany

[73] Assignee: Man GHH Schienenverkehrstechnik GmbH, Nürnberg, Germany

[21] Appl. No.: 52,722

[22] Filed: Apr. 26, 1993

[30] Foreign Application Priority Data

Apr. 28, 1992 [DE] Germany ..... 4213948

[51] Int. Cl.[6] ..... B61D 17/00

[52] U.S. Cl. ..... 105/4.1; 105/8.1; 280/403

[58] Field of Search ..... 105/4.1, 5, 8.1; 213/75 R; 280/403, 408, 410, 411.1, 446.1, 483, 488, 489

[56] References Cited

U.S. PATENT DOCUMENTS

| | | | |
|---|---|---|---|
| 3,922,971 | 12/1975 | Maroshick | 105/8.1 X |
| 4,421,339 | 12/1983 | Hagin | 280/403 X |
| 4,458,911 | 7/1984 | Chadwick et al. | 105/4.1 X |
| 4,579,063 | 4/1986 | Losa et al. | 105/8.1 X |
| 4,781,123 | 11/1988 | Yoshihara | 105/8.1 |
| 4,906,113 | 3/1990 | Sague | 384/618 |
| 5,052,707 | 10/1991 | Timan | 105/8.1 X |
| 5,053,602 | 10/1991 | Aharon | 219/121.78 |

FOREIGN PATENT DOCUMENTS

| | | | |
|---|---|---|---|
| 1042391 | 10/1958 | Germany | 280/403 |

*Primary Examiner*—Robert J. Oberleitner
*Assistant Examiner*—S. Joseph Morano
*Attorney, Agent, or Firm*—George J. Brandt, Jr.

[57] ABSTRACT

Rail vehicle with at least two car bodies wherein at or near their connecting point a truck is provided which carries both car bodies, wherein furthermore an intermediate link is arranged between the car bodies, and one car body is rotatably mounted at the intermediate link about a lateral axis, and the other car body is rotatably mounted at the intermediate link about a vertical axis.

5 Claims, 4 Drawing Sheets

RAIL VEHICLE HAVING ARTICULATED CONNECTION BETWEEN VEHICLE BODIES FOR PROHIBITING TELESCOPING IN CASE OF ACCIDENTS

The invention refers to a rail vehicle and more particularly to a rail vehicle in which adjacent ends of two car bodies are supported on a common truck.

Multiple unit urban transit trains generally have no walkways between individual car bodies. If they do, the walkways are walkable only in case of emergency, or the trains are equipped—as is customary in mainline rail vehicles —with walkways protected by bellows and rubber seals, and with hinged gangways as floors.

In the case of close-coupled, four-axled vehicles, some lateral movement of the end walls must be accepted, which occurs when relieving arches are negotiated, and which limits the possible active width of the walkway.

In articulated trains with center-bogie design, adjacent car bodies are mounted on a joint truck, and generally each car body is equipped with its own king pin or coupling point and with a separate secondary suspension system. This reduces the relative motions of the car bodies against each other to the secondary-level lateral plays, but even these can still be in the range of 80–100 mm during double motions of the car bodies. This makes it difficult to design a floor that can be walked on at an even level.

The mechanical coupling of the car bodies directly or indirectly via the truck has a considerable influence on the dynamics of the train system.

Lateral forces from the car bodies' own dynamics are influencing the lateral dynamics of the running gear via the necessary lateral plays in the secondary level and the off-center position of the crossfeed stops.

The disadvantages of the principle are also felt in the opposite direction. If the lateral play of the car bodies is limited to achieve the greatest possible walkover width, even relatively minor lateral disturbances in the track system will lead to an excursion of the car bodies and can thus cause the hunting of the entire train.

The transmission of longitudinal forces usually takes place in a plane that is offset against the undercarriage. Coupling elements of finite length, such as push-pull rods, or the truck frame itself, react with instability when tractive forces and impact forces occur. If the tractive forces are unevenly distributed within the train unit, as is the case, for example with an axle arrangement of Bo'+Bo'+2'+Bo'+Bo', some portions (25% in the example named) of the occurring tractive forces are always transmitted via the outer coupling elements. In case of an overrunning collision, the coupling element forces a lateral and vertical displacement of the car ends. Since in order to provide the widest possible walkway, the end pillars of the car bodies must be close to the side wall plane, the danger of telescoping in case of an accident cannot be effectively prevented.

The coupling elements as well as the double arrangement of the secondary suspension are considerably restricting of the installation space within the joint truck, making it difficult or even impossible to design it as a power truck.

Object of the invention is to develop a rail vehicle as an articulated train in such a way that it is walkable and visible throughout its entire length and across its full width without major restrictions, in which the car bodies are in the usual way largely uncoupled from the running gear, in which longitudinal forces of usual magnitude can be transferred, in which the telescoping of the open car body ends during accidents is prevented, and in which any number of trucks can be equipped with drives.

According to the invention, an intermediate link is provided between at least two car bodies of a rail vehicle, wherein one car body is rotatably mounted on the intermediate link about a lateral axis and the other car body is rotatably mounted on the intermediate link about a vertical axis.

Advantageously the mountings for the car bodies on the intermediate link are elastic in torsional direction.

According to a preferred embodiment of the invention, the undercarriages of the car bodies below the intermediate link are provided with stops that are centered against one another.

According to another preferred embodiment of the invention, an upper portion of the car body that is rotatably mounted on the intermediate link about a vertical axis is connected with the intermediate link via a guide rod, which preferably has an elastic cardanic mounting on both sides.

According to a preferred embodiment, beams cantilevering from the lower plane of one car body in the direction of the intermediate link and bushings arranged on said beams are connected in a horizontal axis located laterally to the car body with bearing supports at, under or on the lower plane of the intermediate link, and beams cantilevering from the lower plane of the other car body in the direction of the intermediate link are connected to a turntable arranged centrally on or below the lower plane of the intermediate link.

Preferably the turntable consists of a preloaded cross roller bearing, and advantageously the rotating points of both car bodies are lying in one plane during straight line travel.

To obtain the greatest possible width for the inside space of the walkway that is evenly walkable, it is necessary to directly or indirectly support two adjacent car bodies on one truck, to eliminate relative motions when relieving arches, rises and hollows must be negotiated. Another condition is a flexible connection between the two car bodies in such a form that the vertical and lateral axes of the joint share a common intersection near the top edge of the floor.

To reduce the angles to be bridged between the car bodies, it is practical to insert an intermediate link, for example in the form of an intermediate link that bisects the angle being guided by adjustment mechanisms or spring elements or is linked in such a way that the angles resulting from curve travel and travel over rises and hollows are assigned to each of the two walkway sectors. Thus in case of a design with bellows, the folds can be kept to a minimum, since the bellows can be designed only for a single movement instead of a combined movement between the car bodies.

To achieve such a division of angular movements, one of the two car bodies is mounted on the lateral support of the intermediate link via two external cantilever beams into which large-volume elastomer bushings are positively pressed-in.

The second car body is mounted via two interior cantilever beams with pressed-in elastomer bushings on a turntable, preferably a preloaded cross roller bearing, which is arranged centrally on the lateral support of the intermediate link. The intermediate link is stabilized against the car body via a guide rod, whose both ends are elastically mounted.

If it is necessary because of an extremely small curve radius to lead the intermediate link to bisect the lateral axis, the guide rod can be replaced by a linkage arrangement which absorbs the relative movements in x direction between the two car bodies, and transmits half of them to the intermediate link.

The elastomer bushings, which are identical for both car bodies and lie in one axis when the train is on a straight track, are of such dimensions that they can transfer the load, the lateral force and the torsion of the car bodies to one another.

To achieve sufficient preloading of the rubber volume in the elastomer bushings for the required spring excursions, said bushings are practically designed in such a way that the rubber at the fastening bolts is vulcanized and receives the required preloading when pressed into a hole of the cantilever beam. It is practical to secure the elastomer bushing by providing it and the contour of the hole with appropriate shapes.

The elasticity of the bushing due to its geometry in the longitudinal direction of the train makes possible the elastic transfer of tractive forces and coupling forces. If a definable magnitude, for example the final force of 150 kN assumed for shock absorbing elements, is reached, the elastic longitudinal travel is limited by stops formed preferably by central extensions of the undercarriages, arranged between the cantilever beams. Thus it is possible to transfer buffer forces according to UIC or AAR standards without regard to the construction of the joint.

In case of an overrunning collision or in case of accidents, the cup shape of the interlocking end stops causes the car bodies to be centered, which—if the lateral forces stabilizing the joint are exceeded—can lead to buckling, but not to telescoping.

The trucks, which can be designed as conventional bolsterless air-sprung trucks, can be arranged directly under the lateral support of the intermediate link, wherein lateral travel can be limited via a centrally arranged emergency pilot, and wherein it would be practical to transfer the tractive forces to the undercarriage of one of the adjacent car bodies via a guide rod provided on one side. This enables the even distribution of tractive forces throughout the train unit, so that only the differential forces from different adhesion conditions must be transferred via the joints.

The installation height and coupling of the truck at the intermediate link can be identical to those of the self-contained trucks arranged directly on the undercarriage of the end car. This would ensure similarity of construction and interchangeability as well as the flexible arrangement of drives.

If the intermediate link is designed as an intermediate link with appropriately selected installation length, a current collector and its drive can be arranged on same and thus in the middle of the truck. This means that the lateral displacement motions originating in the car body dynamics and acting upon the current collector shoe are minimized, and that there is a greater choice in selecting a certain angle of incline for the car body.

The invention will now be described in detail with reference to the following drawings.

Figure 1:
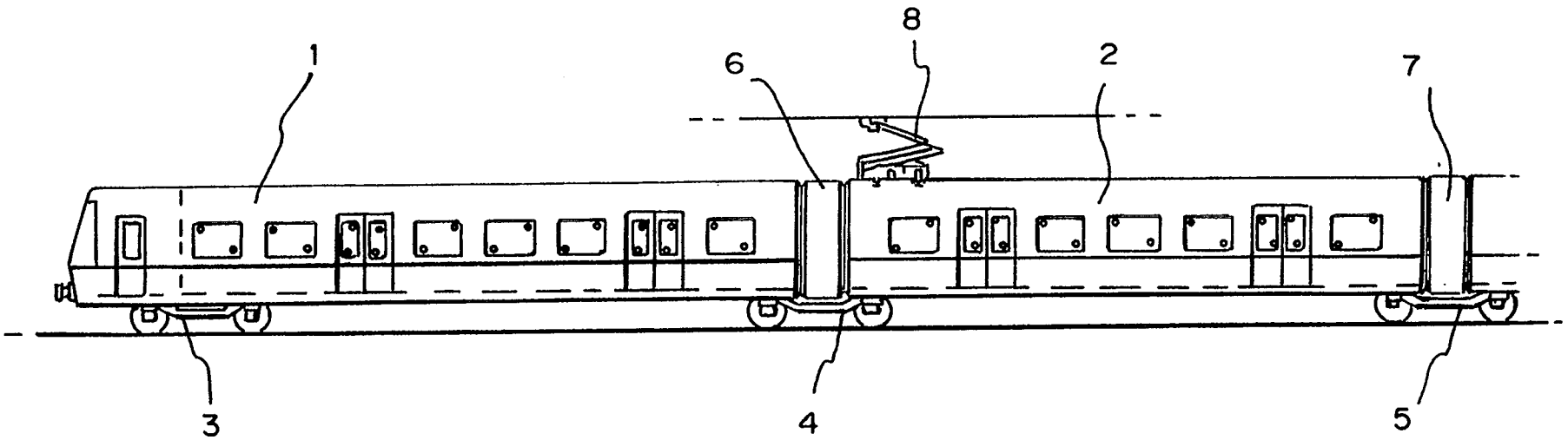
FIG. 1 shows an embodiment of the rail vehicle according to the invention, with portals as intermediate links.

The rail vehicle according to FIG. 1 consists of several car bodies 1, 2 on trucks 3, 4, 5, wherein two car bodies 1, 2 are always mounted on one truck 4. Arranged between the car bodies are connecting elements, in this case portals 6, 7. On top of one car body 2 a current collector 8 is arranged.

Figure 2:
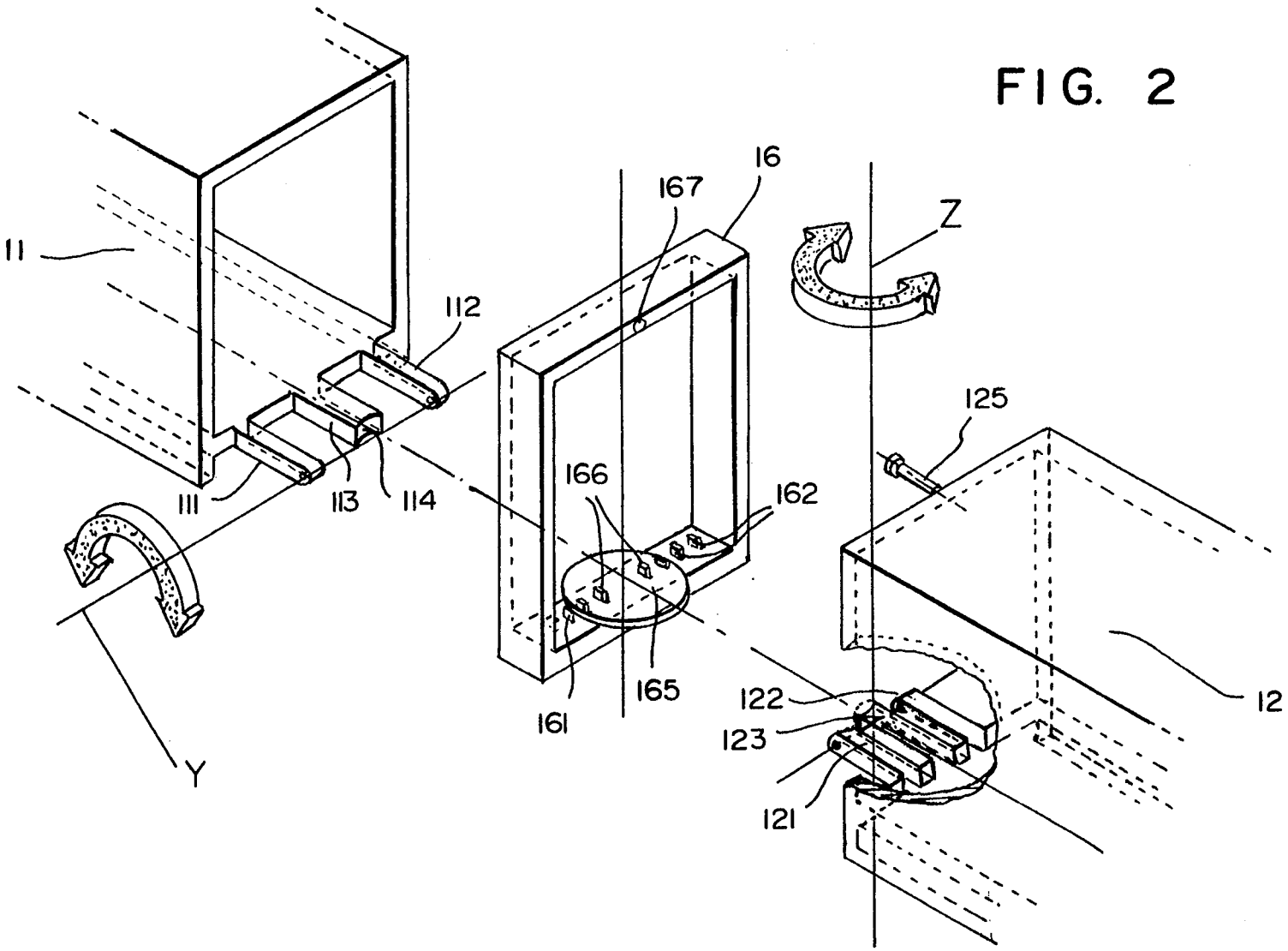
FIG. 2 shows a connection with portal.

The connection between car bodies 11, 12 by means of a portal 16 is shown in FIG. 2. Car body 11 is pivotably connected to the portal about a lateral axis Y. For this purpose it is provided on its bottom with two cantilever beams 111, 112 extending at a distance from each other to the lower cross brace of portal 16. In the connected state, the cantilever beams 111, 112 engage in the portal, where they are held by means of elastic bearings in bearing supports 161, 162. In that state, lateral axis Y extends along bearing supports 161, 162. Between cantilever beams 112 and 111, a stop bar 113 is arranged extending in the same direction and lying in the same plane. In the connected state, the cup-shaped end 114 of this stop bar 113 comes to rest over the center of the lower cross brace of portal 16. The other car body 12 is provided with a similar connection with portal 16. Here two, cantilever beams 121, 122 are provided which are arranged in such a way that they can engage between cantilever beams 111 and 112 of the first car body 11, leaving enough space between them for a stop bar 123 whose end fits into the cup-shaped recess 114 of stop bar 113 on the first car body. In the connected state the two stop bars 113 and 123 abut each other with play and prevent the telescoping of the two car bodies in case of accidents. Cantilever beams 121, 122 of the second car beady are held with elastic bearings in bearing supports 166, arranged on turntable 165 in the middle of the lower cross beam of portal 16. Extending through the center point of this turntable 165 in the connected state is vertical axis Z, about which the second car body 12 is pivotably mounted in the portal. During straight line travel the lateral axes of the journal boss of all cantilever beams 111, 112, 121, 122 extend along the lower cross brace of portal 16 in a vertical and horizontal plane. The second car body 12 is connected to the upper cross brace of portal 16 via a guide rod 125, receivable in upper cross brace opening 167, the guide rod having an elastic cardanic mounting on both sides.

Figure 3:
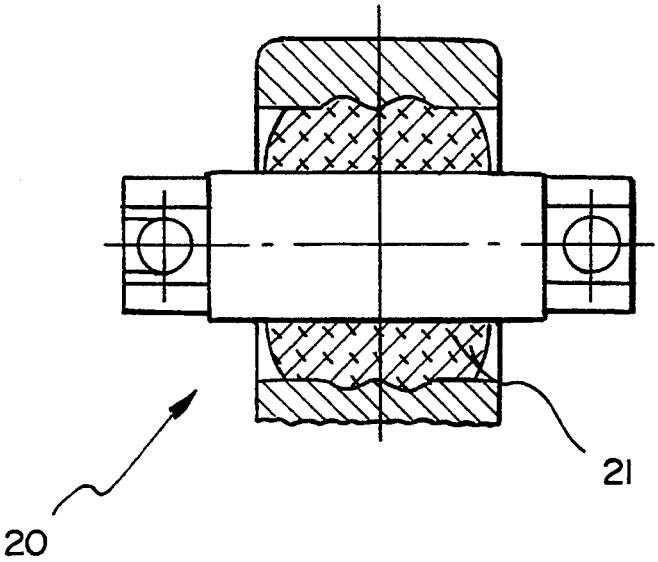
FIG. 3 and 4 show a rubber element for mounting the cantilever beams on the portal.
Figure 4:
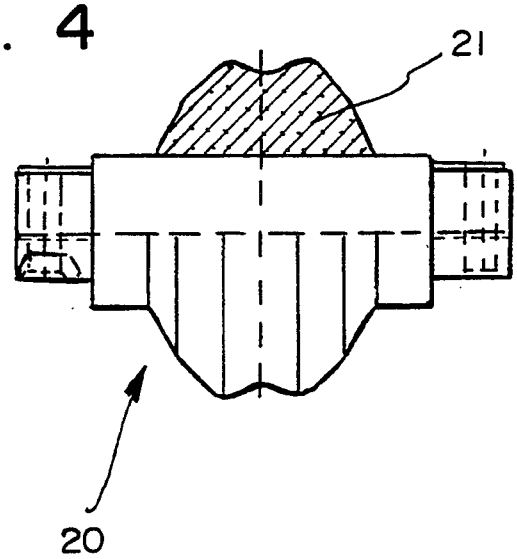

FIG. 3 and 4 show an elastic bearing element 20 with an elastomer 21. FIG. 4 shows the bearing element when not installed, while FIG. 3 shows it in the inserted state.

Figure 5:
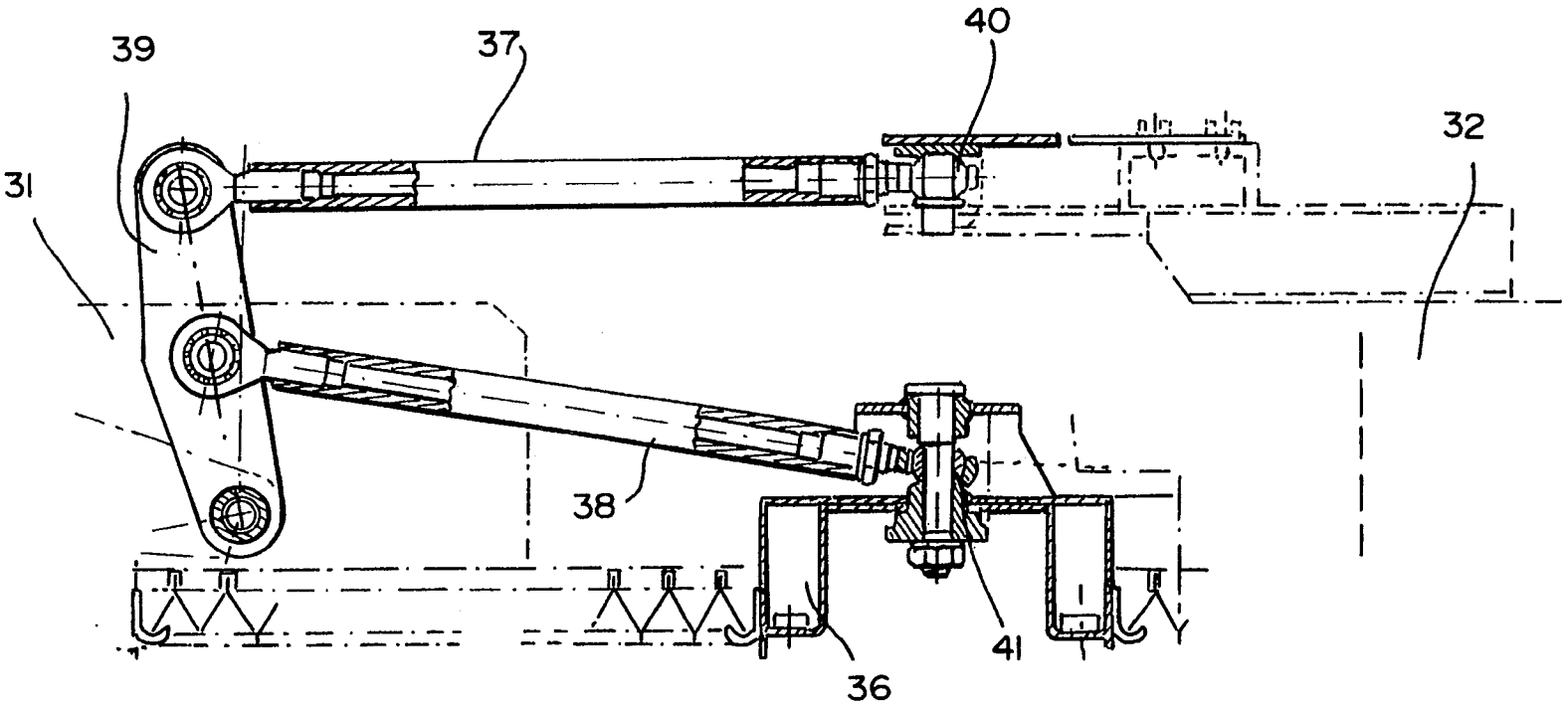
FIG. 5 shows an alternative connection between the top of the portal and the car bodies.

Instead of the guide rod shown in FIG. 2, it is also possible to connect the second car body 32 with portal 36 via a linkage, as shown in FIG. 5. The linkage consists of two rods 37, 38, each with an elastic cardanic mounting on both ends. One of the rods is fastened on one side to the second car body 32 and on the other side to a transmission link 39 rotatably fastened to the first car body 31. Connecting link 39 is an elongated disk whose bottom end provides the connection to the first car body 31 and whose top end provides the connection to rod 37. Between these two connections lies the connection to the second rod 38, whose one end is mounted at connecting link 39 and whose other end is mounted at portal 36.

We claim:

1. A rail vehicle which comprises first and second car bodies aligned such that an end of the first car body is adjacent an end of the second car body, said adjacent car body ends being supported on a common truck, link structure including a portal disposed between said adjacent car body ends for linking said car bodies together, the portal having upper and lower lateral braces, the link structure further having means for connecting the first car body to the portal for first car body rotation relative to the portal about an axis passing laterally of the portal, means for connecting the second car body to the portal for second car body rotation relative to the portal about a vertically directed axis passing centrally through the portal, and a device for preventing telescoping of said adjacent car body ends on happening of an accident, said device comprising a stop bar carried on the end of the first car body, and another stop bar carried at the end of the second car body, said stop bars being carried at a lower part of said car bodies with each stop bar extending centrally longitudinally from its associated car body to a tip end termination thereof proximal the axis passing laterally of the portal, one stop bar having a cup-shaped recess at its tip end in which the tip end of the other stop bar fits and abuts therewith so in event of an accident, said stop bars center against each in car body adjacent ends telescoping preventing relation.

2. A rail vehicle in accordance with claim 1 in which the means for connecting the first car body to the portal comprises a pair of cantilever beams extending from the first car body end, and bearing supports including elastic bearing elements carried on the portal lower lateral bracing, free ends of the pair of cantilever beams being connected in said elastic bearing elements, the means for connecting the second car body to the portal comprising another pair of cantilever beams extending from the second car body end, other bearing supports including elastic bearing elements, and a turntable mounted on the portal lower lateral bracing centrally thereon, the other bearing supports being carried on the turntable, free ends of said other pair of cantilever beams being connected in the elastic bearing elements of said other bearing supports.

3. A rail vehicle in accordance with claim 2 in which the turntable is a preloaded cross roller bearing.

4. A rail vehicle in accordance with claim 1 in which during straight line travel of the two car bodies, the laterally passing axis and the vertically directed axis lie in a common plane.

5. A rail vehicle in accordance with claim 1 which an upper part of the second car body is connected to the portal with a linkage unit, the linkage unit comprising a rod connected at one end to the second car body and at an opposite end to an end of a transmission link, the transmission link at an opposite end being pivoted to an upper part of the first car body and another rod connected at an end thereof to the transmission link intermediate its ends, an opposite end of the other rod being connected to an upper part of the portal, the connections at each end of the rod and said other rod being elastic cardanic mountings.

* * * * *